US010690083B2

(12) United States Patent
Kuroda et al.

(10) Patent No.: US 10,690,083 B2
(45) Date of Patent: Jun. 23, 2020

(54) AIR-FUEL RATION CONTROL APPARATUS FOR ENGINE

(71) Applicant: TOYOTA JIDOSHA KABUSHIKI KAISHA, Toyota-shi (JP)

(72) Inventors: Ryusuke Kuroda, Nissin (JP); Masanao Idogawa, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 196 days.

(21) Appl. No.: 15/648,489

(22) Filed: Jul. 13, 2017

(65) Prior Publication Data

US 2018/0023498 A1 Jan. 25, 2018

(30) Foreign Application Priority Data

Jul. 20, 2016 (JP) ..... 2016-142676

(51) Int. Cl.
*F02D 41/04* (2006.01)
*F02D 41/24* (2006.01)
*F02D 41/30* (2006.01)

(52) U.S. Cl.
CPC ..... *F02D 41/2454* (2013.01); *F02D 41/248* (2013.01); *F02D 41/2422* (2013.01); *F02D 41/2445* (2013.01); *F02D 41/3094* (2013.01)

(58) Field of Classification Search
USPC ..... 701/101–104; 123/435, 436, 674, 445, 123/704
See application file for complete search history.

(56) References Cited

U.S. PATENT DOCUMENTS 4,467,769 A * 8/1984 Matsumura ..... F02D 41/0032 123/520
4,594,985 A * 6/1986 Fujimura ..... F02D 41/2454 123/674
5,193,339 A 3/1993 Furuya
5,243,951 A * 9/1993 Nakaniwa ..... F02D 41/1454 123/674
5,251,437 A 10/1993 Furuya
(Continued)

FOREIGN PATENT DOCUMENTS

GB 2 439 566 A 1/2008
JP 60-224956 A 11/1985
(Continued)

*Primary Examiner* — George C Jin
*Assistant Examiner* — Teuta B Holbrook
(74) *Attorney, Agent, or Firm* — Oblon, McClelland, Maier & Neustadt, L.L.P.

(57) ABSTRACT

The air-fuel ratio feedback control section updates an air-fuel ratio feedback correction value. The air-fuel ratio learning control section performs, in each of learning regions, learning of an air-fuel ratio learning value. If the air-fuel ratio feedback correction value converges to a value less than or equal to a specified value, the air-fuel ratio learning control section determines that learning of the air-fuel ratio learning value in the learning region has been completed. If it has not yet been determined that learning of the air-fuel ratio learning value has been completed in any of the learning regions, the air-fuel ratio learning control section collectively updates the air-fuel ratio learning values of all the learning regions at the time of updating the air-fuel ratio learning value through learning in any of the learning regions.

8 Claims, 5 Drawing Sheets

(56) References Cited

U.S. PATENT DOCUMENTS 5,361,213 A * 11/1994 Fujieda ..... B60K 31/0008 123/406.38
5,450,837 A * 9/1995 Uchikawa ..... F02D 41/1443 123/692
5,577,486 A 11/1996 Harima et al.
5,615,660 A 4/1997 Iwano et al.
5,819,714 A * 10/1998 Bush ..... F02D 41/047 123/673
5,934,248 A * 8/1999 Toyoda ..... F02D 41/083 123/339.12
5,964,208 A * 10/1999 Yamashita ..... F02D 41/1456 123/674
6,405,122 B1 * 6/2002 Yamaguchi ..... F02D 41/1404 701/106
7,270,119 B2 * 9/2007 Mitsutani ..... F02D 41/1482 123/674
2003/0005916 A1 * 1/2003 Osanai ..... F02D 41/0045 123/698
2003/0070421 A1 * 4/2003 Sakai ..... F01N 3/101 60/277
2006/0137668 A1 * 6/2006 Honda ..... F02D 41/047 123/674
2006/0207559 A1 * 9/2006 Kinose ..... F02D 41/2445 123/431
2012/0065870 A1 3/2012 Okazaki
2015/0152804 A1 * 6/2015 Sakayanagi ..... F02D 41/2416 701/115
2016/0061130 A1 * 3/2016 Morihiro ..... F01N 11/007 60/276
2017/0314499 A1 * 11/2017 Urano ..... F02D 41/1475

FOREIGN PATENT DOCUMENTS

JP 61164051 A * 7/1986
JP 8-4579 1/1996
JP 8-246920 9/1996
JP 2005-105978 4/2005
JP 2006-258037 9/2006

* cited by examiner

| | | | | | | |
|---|---|---|---|---|---|---|
| Port Injection | Cold Operation | RP11 | RP12 | RP13 | RP14 | RP15 |
| | Warm Operation | RP21 | RP22 | RP23 | RP24 | RP25 |
| Direct Injection | Cold Operation | RP31 | RP32 | RP33 | RP34 | RP35 |
| | Warm Operation | RP41 | RP42 | RP43 | RP44 | RP45 |

GA1 GA2 GA3 GA4 → Great

Intake Air Amount GA

| | | | | | | | |
|---|---|---|---|---|---|---|---|
| Port Injection | Cold Operation | RP11 | RP12 | RP13 | RP14 | RP15 | GP11 |
| | Warm Operation | RP21 | RP22 | RP23 | RP24 | RP25 | GP12 |
| Direct Injection | Cold Operation | RP31 | RP32 | RP33 | RP34 | RP35 | GP13 |
| | Warm Operation | RP41 | RP42 | RP43 | RP44 | RP45 | GP14 |

AIR-FUEL RATION CONTROL APPARATUS FOR ENGINE

BACKGROUND OF THE INVENTION

The present invention relates to an air-fuel ratio control apparatus for an engine that performs air-fuel ratio learning control.

To equalize the air-fuel ratio of air-fuel mixture combusted in the cylinders of the engine with a target air-fuel ratio, the amount of air combusted in the cylinders (in-cylinder air amount) may be obtained, and the fuel supply amount may be determined such that the ratio of the fuel supply amount to the in-cylinder air amount is equalized with the target air-fuel ratio. However, the output property of an air flowmeter used to calculate the in-cylinder air amount and the injection property of an injector that injects fuel differ among individuals and change over time. Thus, if the fuel supply amount is simply determined in accordance with the in-cylinder air amount calculated from the detection result of the air flowmeter, the air-fuel ratio may vary with respect to the target air-fuel ratio. The variation of the air-fuel ratio is corrected by performing air-fuel ratio feedback control that corrects the fuel supply amount in accordance with the deviation of the air-fuel ratio from the target air-fuel ratio.

Air-fuel ratio learning control is further performed that learns the variation of the air-fuel ratio as an air-fuel ratio learning value from the result of the air-fuel ratio feedback control. The air-fuel ratio learning value that has been learned is previously reflected in the fuel supply amount so that the responsiveness of the air-fuel ratio feedback control is improved. The variation tendency of the air-fuel ratio varies even in the same engine depending on the operating region of the engine. Thus, learning of the air-fuel ratio learning value is desirably performed separately for each operating region. For example, the air-fuel ratio control apparatus disclosed in Japanese Laid-Open Patent Publication No. 2006-258037 performs, in an engine that includes two types of injectors for port injection and for direct injection, learning of the air-fuel ratio learning value for learning regions divided in accordance with the type of the injector, warm operation/cold operation of the engine, and the intake air amount.

However, segmentation of the operating regions (learning regions) for separate learning reduces the time spent for each learning region and reduces the learning opportunities of each learning region. Thus, the time required for completing learning of all the learning regions is exponentially increased in accordance with the increase in the number of the learning regions.

The air-fuel ratio control apparatus disclosed in Japanese Laid-Open Patent Publication No. 2006-258037 calculates, based on the air-fuel ratio learning value of the learning region in which learning has been completed, the air-fuel ratio learning values of other learning regions in which only the intake air amount differs by, for example, a linear interpolation. This advances learning of the air-fuel ratio learning values in the learning regions with small learning opportunities. The air-fuel ratio control apparatus disclosed in the Japanese Laid-Open Patent Publication No. 2005-105978 stores the variation tendency in the air-fuel ratio of each learning region on an air-fuel ratio learning map and calculates the air-fuel ratio learning values of other learning regions from the air-fuel ratio learning value of the learning region in which learning has been completed using the air-fuel ratio learning map.

In the air-fuel ratio control apparatuses of the above publications, the learned result of the learning region in which learning has been completed is reflected in the air-fuel ratio learning values of other learning regions to improve the efficiency in learning the air-fuel ratio. In the air-fuel ratio control apparatuses of the above publications, after learning of the air-fuel ratio learning value has been completed in any of the learning regions, learning in other learning regions is promoted. However, learning needs to be advanced separately in each learning region until learning in other learning regions is promoted. Thus, when the air-fuel ratio learning value needs to be learned from the beginning in all the learning regions, such as after clearing the battery, relatively long time is taken until the air-fuel ratio is learned efficiently.

SUMMARY OF THE INVENTION

Accordingly, it is an objective of the present invention to provide an air-fuel ratio control apparatus for an engine that efficiently learns an air-fuel ratio learning value from an early stage.

To achieve the foregoing objective and in accordance with a first aspect of the present invention, an air-fuel ratio control apparatus is provided that controls an air-fuel ratio of air-fuel mixture combusted in an engine to a target air-fuel ratio by correcting a fuel supply amount in accordance with an air-fuel ratio feedback correction value and an air-fuel ratio learning value. The apparatus includes an air-fuel ratio feedback control section and an air-fuel ratio learning control section. The air-fuel ratio feedback control section updates the air-fuel ratio feedback correction value such that the difference between the air-fuel ratio and the target air-fuel ratio is reduced. The air-fuel ratio learning control section performs, in each of a plurality of learning regions divided in accordance with an operating condition of the engine, learning of the air-fuel ratio learning value, in which the air-fuel ratio learning value is updated to reduce the air-fuel ratio feedback correction value and the updated air-fuel ratio learning value is stored. If the air-fuel ratio feedback correction value converges to a value less than or equal to a specified value in each learning region, the air-fuel ratio learning control section determines that learning of the air-fuel ratio learning value in the learning region has been completed. If it has not yet been determined that learning of the air-fuel ratio learning value has been completed in any of the learning regions, the air-fuel ratio learning control section collectively updates the air-fuel ratio learning values of all the learning regions at the time of updating the air-fuel ratio learning value through the learning in any of the learning regions.

With the air-fuel ratio control apparatus configured as described above, the deviation of the air-fuel ratio from the target air-fuel ratio is corrected through updating of the air-fuel ratio feedback correction value performed by the air-fuel ratio feedback control section. The air-fuel ratio converges to the target air-fuel ratio at an early stage by previously reflecting, in the fuel supply amount, the air-fuel ratio learning value that has been updated and stored by the air-fuel ratio learning control section in each learning region. The air-fuel ratio learning value of each learning region updated and stored by the air-fuel ratio learning control section reflects the variation of the air-fuel ratio in each learning region.

The variation of the air-fuel ratio of each learning region is the sum of the variation of the individual engine and the variation specific to each learning region. In the above-described air-fuel ratio control apparatus, if learning of the air-fuel ratio learning value has not been completed in any of the learning regions, the air-fuel ratio learning values of all the learning regions are collectively updated. In this case, among the variations of the air-fuel ratio as described above, the air-fuel ratio learning value of each learning region, although not reflecting the variation specific to each learning region, reflects the variation specific to the individual engine. Thus, in a stage in which learning has not been completed in any of the learning regions, the learned result of the learning region that is currently under learning is reflected in the air-fuel ratio learning values of other learning regions. Thus, the above-described air-fuel ratio control apparatus for an engine increases the efficiency in learning the air-fuel ratio learning value from an earlier stage.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

An air-fuel ratio control apparatus for an engine according to a first embodiment of the present invention will now be described with reference to FIGS. 1 to 5.

Figures 1, 2:
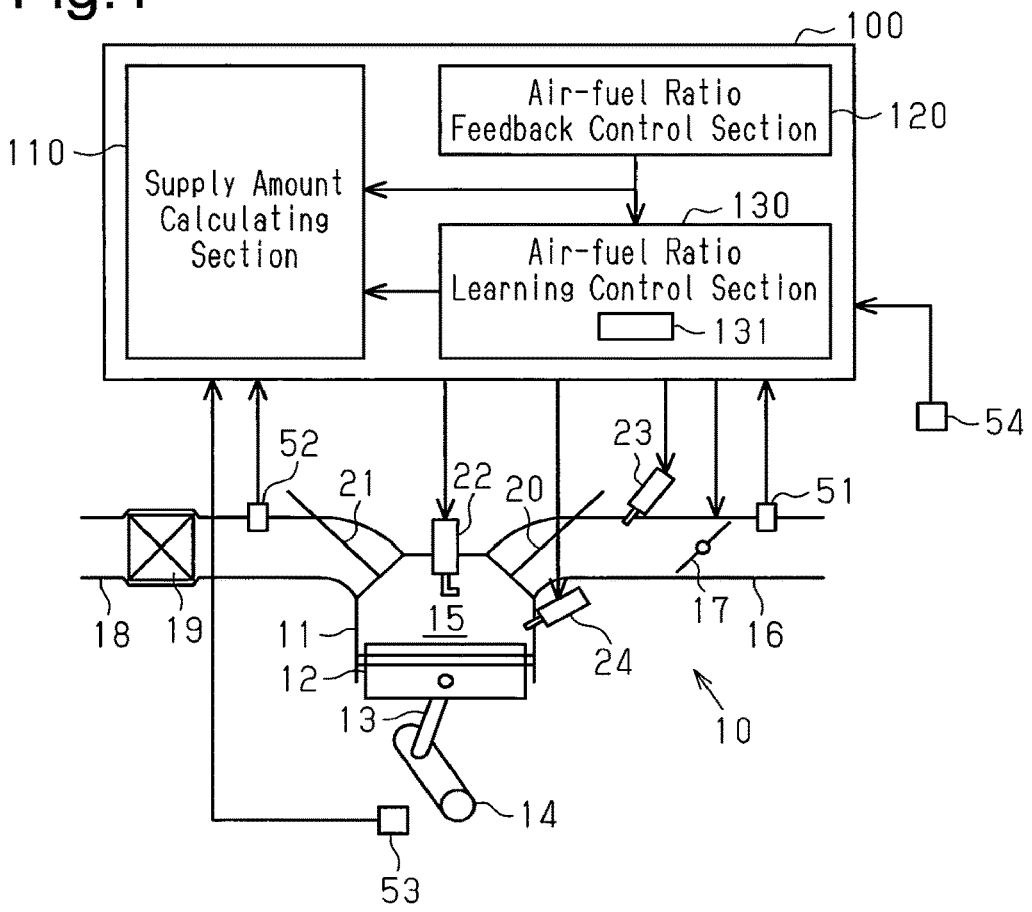
FIG. 1 is a block diagram illustrating an engine including a control apparatus, which is an air-fuel ratio control apparatus for an engine according to a first embodiment, and a functional configuration of the control apparatus.
FIG. 2 is an explanatory diagram illustrating learning regions of the air-fuel ratio control apparatus for an engine according to the first embodiment.

FIG. 1 illustrates an engine 10. The engine 10 includes a control apparatus 100, which functions as an air-fuel ratio control apparatus. As shown in FIG. 1, the engine 10 includes cylinders 11 (only one is shown in FIG. 1). Each cylinder 11 accommodates a piston 12. Each piston 12 is coupled to a crankshaft 14 via a connecting rod 13. The section in each cylinder 11 above the piston 12 forms a combustion chamber 15 in which air-fuel mixture containing fuel is combusted.

An intake passage 16 introduces intake air into the combustion chambers 15. A throttle valve 17, which adjusts the intake air amount GA, and an air flowmeter 51, which detects the intake air amount GA, are provided in the intake passage 16. Exhaust gas discharged from the combustion chambers 15 flows through an exhaust passage 18. An exhaust purifying catalyst 19, which purifies exhaust gas that flows through the exhaust passage 18, is provided in the exhaust passage 18. An air-fuel ratio sensor 52, which detects concentration of oxygen included in the exhaust gas, is provided in the exhaust passage 18 upstream of the exhaust purifying catalyst 19. Opening and closing of the intake passage 16 with respect to each combustion chamber 15 is performed by an intake valve 20, and opening and closing of the exhaust passage 18 with respect to each combustion chamber 15 is performed by an exhaust valve 21.

The engine 10 includes ignition plugs 22, which ignite the air-fuel mixture, port injectors 23, which inject fuel to the intake port of the intake passage 16, and direct injectors 24, which directly inject fuel to the combustion chambers 15. In this embodiment, each of the cylinders 11 is provided with the injector 23 for port injection and the injector 24 for direct injection.

The control apparatus 100 is electrically connected to a crank position sensor 53 and an acceleration pedal sensor 54 in addition to the air flowmeter 51 and the air-fuel ratio sensor 52. The crank position sensor 53 detects an engine rotational speed NE, which is the rotational speed of the crankshaft 14. The acceleration pedal sensor 54 detects an acceleration pedal depression degree AC, which is the depression degree of the acceleration pedal. The control apparatus 100 controls operation of the engine 10 in accordance with the information detected by the above various sensors 51 to 54.

Next, the functional configuration of the control apparatus 100 will be described with reference to FIG. 1.

As shown in FIG. 1, the control apparatus 100 includes a supply amount calculating section 110, an air-fuel ratio feedback control section 120, and an air-fuel ratio learning control section 130. The supply amount calculating section 110 is a functional section for calculating a fuel supply amount Qfin to each cylinder 11 in one injection.

The air-fuel ratio feedback control section 120 obtains the difference between a target air-fuel ratio and the air-fuel ratio calculated based on the oxygen concentration detected by the air-fuel ratio sensor 52 and updates an air-fuel ratio feedback correction value FAF such that the difference is reduced.

When a predetermined learning condition is satisfied, the air-fuel ratio learning control section 130 updates an air-fuel ratio learning value KG such that the air-fuel ratio feedback correction value FAF is reduced and stores the updated air-fuel ratio learning value KG in a memory 131. The present embodiment provides learning regions divided in accordance with the type of the injectors 23, 24, which perform fuel injection, whether warm operation or cold operation is being performed, and the intake air amount GA. The memory 131 stores the air-fuel ratio learning values KG of all the learning regions. The air-fuel ratio learning control section 130 learns the air-fuel ratio learning value KG of each learning region divided as described above. When the air-fuel ratio feedback correction value FAF in one of the learning regions during operation of the engine is converged to a value less than or equal to a specified value, the air-fuel ratio learning control section 130 determines that learning of the air-fuel ratio learning value KG in that learning region has been completed and sets a learning completion flag FLG corresponding to that learning region to 1. The learning completion flags FLG corresponding to the learning regions in which learning of the air-fuel ratio learning value KG has not been completed are not set to 1.

The supply amount calculating section 110 multiplies a base supply amount Qbase by the sum of the air-fuel ratio learning value KG and the air-fuel ratio feedback correction value FAF, and the product (Qbase×(KG+FAF)) is defined as the fuel supply amount Qfin. The air-fuel ratio learning value KG and the air-fuel ratio feedback correction value FAF are values greater than or equal to zero. At this time, the supply amount calculating section 110 reads the air-fuel ratio learning value KG of the learning region that includes the current operating condition of the engine 10 from the memory 131 and calculates the fuel supply amount Qfin using the air-fuel ratio learning value KG that has been read. The base supply amount Qbase is obtained by dividing the in-cylinder air amount, which is the amount of air combusted in the cylinder 11, by the target air-fuel ratio. The in-cylinder air amount is calculated based on the intake air amount GA, which is detected by the air flowmeter 51, and the opening degree SC of the throttle valve 17.

Next, the learning regions RP11 to RP15, RP21 to RP25, RP31 to RP35, and RP41 to RP45 will be described with reference to FIG. 2. In FIG. 2, fuel injection performed by the port injector 23 is indicated as "Port Injection", and fuel injection performed by the direct injector 24 is indicated as "Direct Injection".

As shown in FIG. 2, when the injector that performs fuel injection is the port injector 23 and cold operation is being performed, five learning regions RP11, RP12, RP13, RP14, and RP15 are provided in accordance with the intake air amount GA. The learning region RP11 is a region in which the intake air amount GA is less than a first intake air amount GA1. The learning region RP12 is a region in which the intake air amount GA is less than a second intake air amount GA2, which is greater than the first intake air amount GA1, and greater than or equal to the first intake air amount GA1. The learning region RP13 is a region in which the intake air amount GA is less than a third intake air amount GA3, which is greater than the second intake air amount GA2, and greater than or equal to the second intake air amount GA2. The learning region RP14 is a region in which the intake air amount GA is less than a fourth intake air amount GA4, which is greater than the third intake air amount GA3, and greater than or equal to the third intake air amount GA3. The learning region RP15 is a region in which the intake air amount GA is greater than or equal to the fourth intake air amount GA4.

When the injector that performs fuel injection is the port injector 23 and warm operation is being performed, five learning regions RP21, RP22, RP23, RP24, and RP25 are provided in accordance with the intake air amount GA. The learning region RP21 is a region in which the intake air amount GA is less than the first intake air amount GA1. The learning region RP22 is a region in which the intake air amount GA is greater than or equal to the first intake air amount GA1 and less than the second intake air amount GA2. The learning region RP23 is a region in which the intake air amount GA is greater than or equal to the second intake air amount GA2 and less than the third intake air amount GA3. The learning region RP24 is a region in which the intake air amount GA is greater than or equal to the third intake air amount GA3 and less than the fourth intake air amount GA4. The learning region RP25 is a region in which the intake air amount GA is greater than or equal to the fourth intake air amount GA4.

When the injector that performs fuel injection is the direct injector 24 and cold operation is being performed, five learning regions RP31, RP32, RP33, RP34, and RP35 are provided in accordance with the intake air amount GA. The learning region RP31 is a region in which the intake air amount GA is less than the first intake air amount GA1. The learning region RP32 is a region in which the intake air amount GA is greater than or equal to the first intake air amount GA1 and less than the second intake air amount GA2. The learning region RP33 is a region in which the intake air amount GA is greater than or equal to the second intake air amount GA2 and less than the third intake air amount GA3. The learning region RP34 is a region in which the intake air amount GA is greater than or equal to the third intake air amount GA3 and less than the fourth intake air amount GA4. The learning region RP35 is a region in which the intake air amount GA is greater than or equal to the fourth intake air amount GA4.

When the injector that performs fuel injection is the direct injector 24 and warm operation is being performed, five learning regions RP41, RP42, RP43, RP44, and RP45 are provided in accordance with the intake air amount GA. The learning region RP41 is a region in which the intake air amount GA is less than the first intake air amount GA1. The learning region RP42 is a region in which the intake air amount GA is greater than or equal to the first intake air amount GA1 and less than the second intake air amount GA2. The learning region RP43 is a region in which the intake air amount GA is greater than or equal to the second intake air amount GA2 and less than the third intake air amount GA3. The learning region RP44 is a region in which the intake air amount GA is greater than or equal to the third intake air amount GA3 and less than the fourth intake air amount GA4. The learning region RP45 is a region in which the intake air amount GA is greater than or equal to the fourth intake air amount GA4.

Next, with reference to the flowchart in FIG. 3, a routine executed by the air-fuel ratio learning control section 130 at the time of updating the air-fuel ratio learning values KG of the learning regions RP11 to RP15, RP21 to RP25, RP31 to RP35, and RP41 to RP45 will be described. The routine is executed on condition that the learning condition of the air-fuel ratio learning value KG is satisfied during operation of the engine 10. The learning condition includes that, for example, various sensors (the air flowmeter 51 and the air-fuel ratio sensor 52) necessary for learning the air-fuel ratio learning value KG are under normal operation and that the engine 10 is under steady operation.

Figure 3:
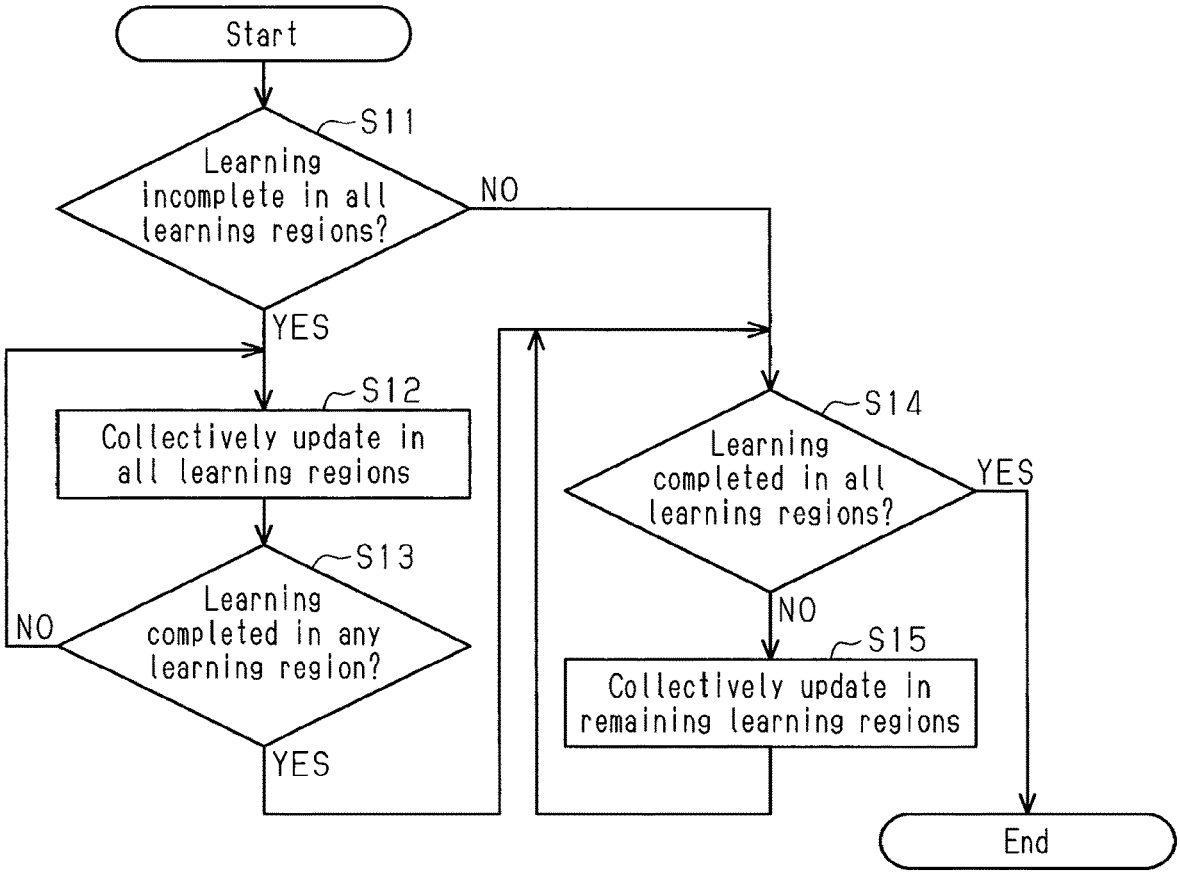
FIG. 3 is a flowchart illustrating a routine executed by the air-fuel ratio control apparatus for an engine according to the first embodiment at the time of updating air-fuel ratio learning values of the learning regions.

As shown in FIG. 3, in this routine, the air-fuel ratio learning control section 130 determines whether learning of the air-fuel ratio learning values KG of all the learning regions RP11 to RP15, RP21 to RP25, RP31 to RP35, and RP41 to RP45 are still incomplete (step S11). The learning completion flag FLG is provided for each of the learning regions RP11 to RP15, RP21 to RP25, RP31 to RP35, and RP41 to RP45. If at least one of the learning completion flags FLG is set to 1, the air-fuel ratio learning control section 130 determines that there is a learning region in which learning of the air-fuel ratio learning value KG has been completed. If none of the learning completion flags FLG is set to 1, the air-fuel ratio learning control section 130 does not determine that there is a learning region in which learning of the air-fuel ratio learning value KG has been completed. That is, the air-fuel ratio learning control section 130 determines that learning of the air-fuel ratio learning value KG has been completed in none of the learning regions RP11 to RP15, RP21 to RP25, RP31 to RP35, and RP41 to RP45. If there is a learning region in which learning of the air-fuel ratio learning value KG has been completed (step S11: NO), the air-fuel ratio learning control section 130 shifts the process to step S14, which will be discussed below. That is, if the air-fuel ratio learning control section 130 has already determined that learning has been completed in any of the learning regions RP11 to RP15, RP21 to RP25, RP31 to RP35, and RP41 to RP45, the air-fuel ratio learning control section 130 shifts the process to step S14.

If learning of the air-fuel ratio learning values KG are still incomplete in all the learning regions RP11 to RP15, RP21 to RP25, RP31 to RP35, and RP41 to RP45 (step S11: YES), the air-fuel ratio learning control section 130 shifts the process to the next step S12. That is, if the air-fuel ratio learning control section 130 has not yet determined that learning of the air-fuel ratio learning value KG has been completed in any of the learning regions RP11 to RP15, RP21 to RP25, RP31 to RP35, and RP41 to RP45, the air-fuel ratio learning control section 130 shifts the process to the next step S12.

In step S12, the air-fuel ratio learning control section 130 collectively updates the air-fuel ratio learning values KG of all the learning regions RP11 to RP15, RP21 to RP25, RP31 to RP35, and RP41 to RP45. For example, in a case in which the engine 10 is operated in the learning region RP13, the air-fuel ratio learning control section 130 updates the air-fuel ratio learning value KG of the learning region RP13 such that the air-fuel ratio feedback correction value FAF is reduced and stores the updated air-fuel ratio learning value KG. The air-fuel ratio learning control section 130 also updates the air-fuel ratio learning values KG of the learning regions other than the learning region RP13. At this time, the air-fuel ratio learning control section 130 equalizes the air-fuel ratio learning values KG of the learning regions other than the learning region RP13 with the air-fuel ratio learning value KG of the learning region RP13 obtained by the above-mentioned learning. If there is a learning region in which learning of the air-fuel ratio learning value KG has been completed through such an updating process, the air-fuel ratio learning control section 130 sets the learning completion flag FLG corresponding to the learning region to 1.

In the engine 10 that is capable of performing the port injection and the direct injection, operation that performs only the port injection, operation that performs only the direct injection, and the operation that performs both the port injection and the direct injection are selected in accordance with the condition. However, if learning of the air-fuel ratio learning value KG has not been completed in all the learning regions RP11 to RP15, RP21 to RP25, RP31 to RP35, and RP41 to RP45, operation that performs both the port injection and the direct injection is not performed. Thus, for example, if the engine 10 is under cold operation, and the intake air amount GA is greater than the second intake air amount GA2 and less than the third intake air amount GA3, either the operation that performs only the port injection and the operation that performs only the direct injection is selected. At this time, for example, in a case in which learning of the air-fuel ratio learning value KG of the learning region for the port injection is performed preferentially, only the port injection is performed, and learning of the air-fuel ratio learning value KG of the learning region RP13 is performed.

Subsequently, the air-fuel ratio learning control section 130 determines whether there is any learning region in which learning of the air-fuel ratio learning value KG has been completed among all the learning regions RP11 to RP15, RP21 to RP25, RP31 to RP35, and RP41 to RP45 (step S13). If there is no learning region in which learning of the air-fuel ratio learning value KG has been completed (step S13: NO), the air-fuel ratio learning control section 130 shifts the process to the aforementioned step S12. If learning of the air-fuel ratio learning value KG has been completed in at least one of the learning regions (step S13: YES), the air-fuel ratio learning control section 130 shifts the process to the next step S14. In step S13, the air-fuel ratio learning control section 130 determines whether there is any learning region in which the learning completion flag FLG is set to 1. If there is a learning region in which the learning completion flag FLG is set to 1, the air-fuel ratio learning control section 130 determines that there is a learning region in which learning of the air-fuel ratio learning value KG has been completed. If there is no learning region in which the learning completion flag FLG is set to 1, the air-fuel ratio learning control section 130 does not determine that there is a learning region in which learning of the air-fuel ratio learning value KG has been completed. If the decision outcome of step S13 is positive (step S13: YES), that is, if it has already been determined that learning has been completed in any of the learning regions RP11 to RP15, RP21 to RP25, RP31 to RP35, and RP41 to RP45, the air-fuel ratio learning control section 130 shifts the process to step S14.

In step S14, the air-fuel ratio learning control section 130 determines whether learning of the air-fuel ratio learning value KG has been completed in all the learning regions RP11 to RP15, RP21 to RP25, RP31 to RP35, and RP41 to RP45. That is, if all the above learning completion flags FLG are set to 1, the air-fuel ratio learning control section 130 determines that learning has been completed in all the learning regions RP11 to RP15, RP21 to RP25, RP31 to RP35, and RP41 to RP45. If learning of the air-fuel ratio learning value KG has been completed in all the learning regions RP11 to RP15, RP21 to RP25, RP31 to RP35, and RP41 to RP45 (step S14: YES), the air-fuel ratio learning control section 130 ends the present routine. If there is a learning completion flag FLG that is not set to 1, the air-fuel ratio learning control section 130 does not determine that learning has been completed in all the learning regions RP11 to RP15, RP21 to RP25, RP31 to RP35, and RP41 to RP45. If there is a learning region in which learning of the air-fuel ratio learning value KG has not been completed (step S14: NO), the air-fuel ratio learning control section 130 shifts the process to the next step S15.

In step S15, when the learning regions in which learning of the air-fuel ratio learning value KG has not been completed are referred to as remaining learning regions, the air-fuel ratio learning control section 130 collectively updates the air-fuel ratio learning values KG in the remaining learning regions. At this time, if the engine 10 is operated in any one of the remaining learning regions, the air-fuel ratio learning values KG of the remaining learning regions are collectively updated through the above-described learning in that learning region. If there is a learning region in which learning of the air-fuel ratio learning value KG has been completed through such an updating process, the air-fuel ratio learning control section 130 sets the learning completion flag FLG corresponding to that learning region to 1 and shifts the process to the aforementioned step S14. The learning region in which learning of the air-fuel ratio learning value KG may be completed is the region in which operation of the engine 10 is performed.

Figure 4:
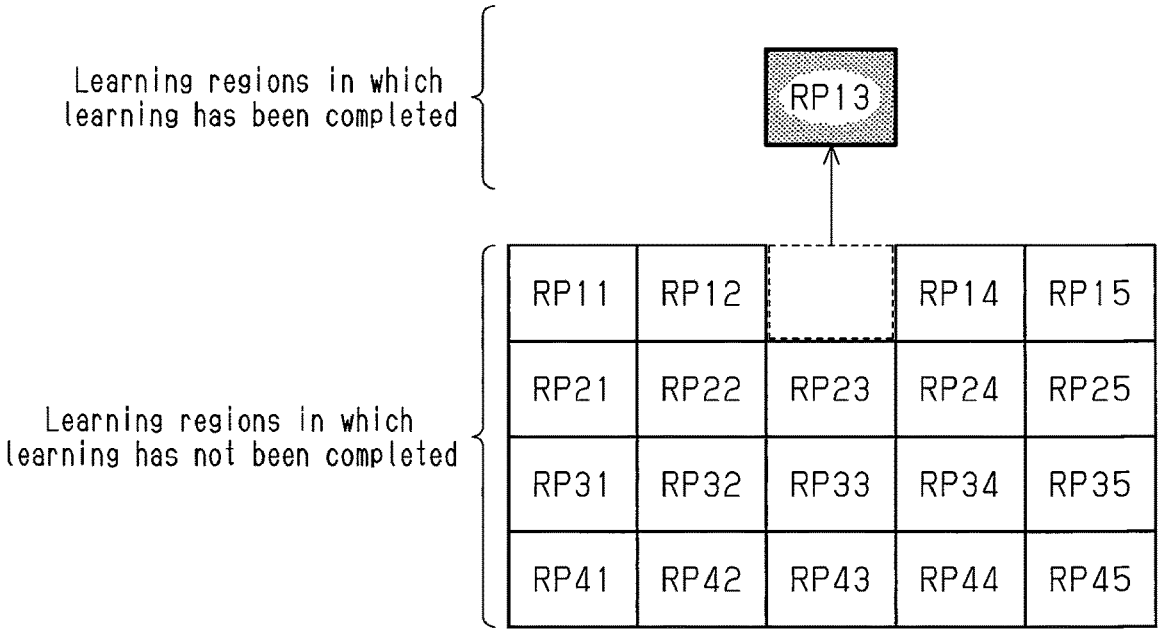
FIG. 4 is an operation diagram illustrating a manner in which the air-fuel ratio control apparatus for an engine according to the first embodiment updates the air-fuel ratio learning values of the learning regions.

Next, operation and advantages when the air-fuel ratio learning values KG of the learning regions RP11 to RP15, RP21 to RP25, RP31 to RP35, and RP41 to RP45 are updated will be described with reference to FIGS. 4 and 5.

For example, after clearing the battery, the air-fuel ratio learning values KG of all the learning regions RP11 to RP15, RP21 to RP25, RP31 to RP35, and RP41 to RP45 are initialized. In this case, none of the learning completion flags FLG corresponding to the learning regions RP11 to RP15, RP21 to RP25, RP31 to RP35, and RP41 to RP45 are set to 1. Thus, if the learning condition is satisfied during operation of the engine 10, the air-fuel ratio learning values KG of all the learning regions RP11 to RP15, RP21 to RP25, RP31 to RP35, and RP41 to RP45 are collectively updated.

The variation of the air-fuel ratio in the learning regions RP11 to RP15, RP21 to RP25, RP31 to RP35, and RP41 to RP45 is obtained by adding the variation specific to each learning region to the variation of the individual engine 10. In this embodiment, if learning of the air-fuel ratio learning value KG has not been completed in any of the learning regions RP11 to RP15, RP21 to RP25, RP31 to RP35, and RP41 to RP45, the air-fuel ratio learning values KG of all the learning regions RP11 to RP15, RP21 to RP25, RP31 to RP35, and RP41 to RP45 are collectively updated. Thus, among the above-described variations of the air-fuel ratio, the air-fuel ratio learning values KG of the learning regions RP11 to RP15, RP21 to RP25, RP31 to RP35, and RP41 to RP45, although not reflecting the variation specific to each learning region, reflect the variation of the individual engine 10 to some degree. Thus, from a stage at which learning of the air-fuel ratio learning value KG has not been completed in any of the learning regions RP11 to RP15, RP21 to RP25, RP31 to RP35, and RP41 to RP45, the learned result of the learning region that is currently under a learning process (for example, the learning region RP13) is reflected in the air-fuel ratio learning values KG of other learning regions. This increases the efficiency in learning the air-fuel ratio from an earlier stage.

For example, if operation of the engine 10 in the learning region RP13 is continued, the air-fuel ratio feedback correction value FAF when the engine 10 is operated in the learning region RP13 converges to a value less than or equal to the specified value. Thus, the learning completion flag FLG corresponding to the learning region RP13 is set to 1, and it is determined that learning of the air-fuel ratio learning value KG of the learning region RP13 has been completed as shown in FIG. 4. After the determination, if the engine 10 is operated in the learning region other than the learning region RP13, the air-fuel ratio learning values KG of the remaining learning regions other than the learning region RP13 are collectively updated.

If the operation of the engine 10 is continued, for example, in the learning region RP11 after completion of learning of the air-fuel ratio learning value KG in the learning region RP13, learning of the air-fuel ratio learning value KG of the learning region RP11 is performed such that the air-fuel ratio feedback correction value FAF is reduced. In this case, the variation of the individual engine 10 was reflected in the air-fuel ratio learning value KG of the learning region RP11 to some degree when learning of the air-fuel ratio learning value KG of the learning region RP13 was performed. Thus, compared with a case in which learning of the air-fuel ratio learning value KG of the learning region RP11 is performed from the beginning after completion of learning of the air-fuel ratio learning value KG of the learning region RP13, learning of the air-fuel ratio learning value KG of the learning region RP11 is completed at an early stage.

Figures 5, 6:
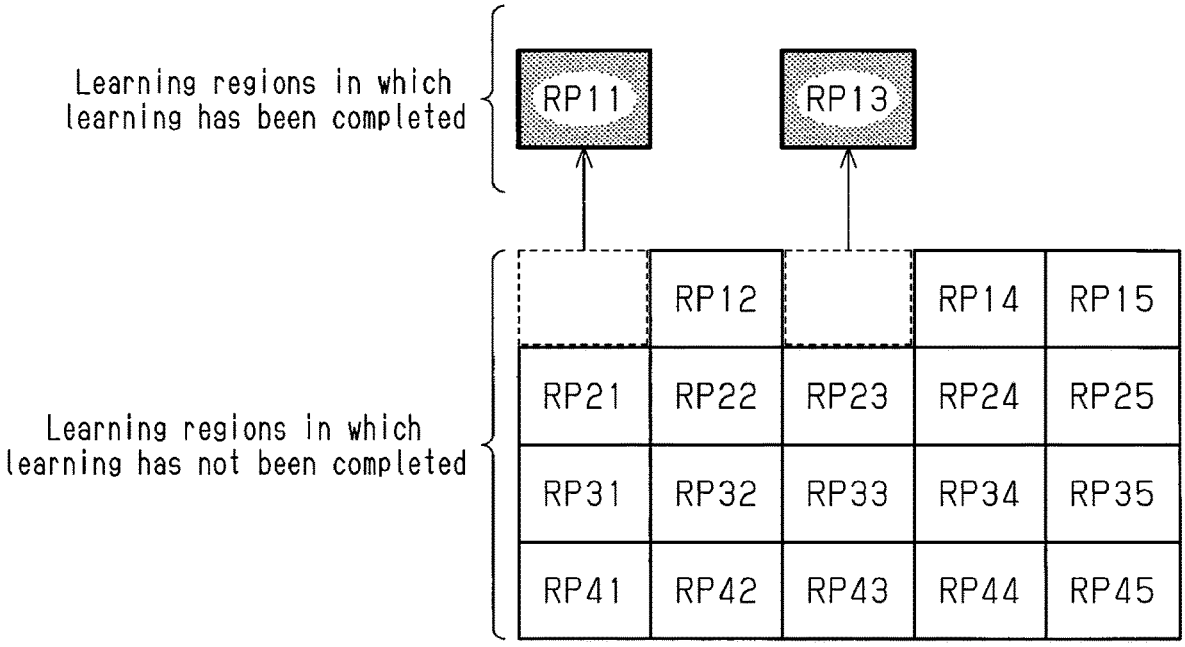
FIG. 5 is an operation diagram illustrating a manner in which the air-fuel ratio control apparatus for an engine according to the first embodiment updates the air-fuel ratio learning values of the learning regions.
FIG. 6 is an explanatory diagram illustrating groupings of the learning regions in an air-fuel ratio control apparatus for an engine according to a second embodiment.

When the air-fuel ratio feedback correction value FAF converges to a value less than or equal to the specified value during operation of the engine 10 in the learning region RP11, the air-fuel ratio learning control section 130 determines that learning of the air-fuel ratio learning value KG in the learning region RP11 has been completed as shown in FIG. 5. Thus, after the determination, if the engine 10 is operated in the learning region other than the learning regions RP11 and RP13, the air-fuel ratio learning values KG of the remaining learning regions other than the learning regions RP11 and RP13 are collectively updated. In this manner, the collective update of the air-fuel ratio learning values KG of the learning regions in which learning has not been completed is continued.

Second Embodiment

An air-fuel ratio control apparatus for an engine according to a second embodiment will now be described with reference to FIGS. 6 and 7. Accordingly, differences from the first embodiment will mainly be discussed below, and like or the same reference numerals are given to those components that are the same as the corresponding components of the first embodiment. Such components will not be described.

In the learning regions with similar variation tendencies of the air-fuel ratio, the air-fuel ratio learning values obtained when learning has been completed are likely to be similar. Thus, in this embodiment, the learning regions RP11 to RP15, RP21 to RP25, RP31 to RP35, and RP41 to RP45 are sorted into groups of regions having similar variation tendencies of the air-fuel ratio. That is, since the type of the injectors that perform fuel injection differs between the case in which the direct injection is performed and the case in which the port injection is performed, the variation tendency of the air-fuel ratio also differs. Thus, the learning regions are sorted into groups based on the types of the injectors that perform injection.

The variation tendency of the air-fuel ratio also differs between the case in which the engine 10 is under cold operation and the case in which the engine 10 is under warm operation. That is, the temperature of the wall surface of the cylinders 11 and the wall surface of the intake passage 16 are low during the cold operation of the engine 10 compared with the temperature of those during warm operation of the engine 10, and fuel is likely to adhere to the wall surface.

Thus, the variation tendency of the air-fuel ratio differs between the case in which the engine 10 is under cold operation and the case in which the engine 10 is under warm operation.

Some of the fuel supplied to the combustion chambers 15 may possibly mix into an oil pan of the engine 10. The fuel that has mixed into the oil pan vaporizes in the oil pan and may return to the combustion chambers 15 via small gaps between the wall surfaces of the cylinders 11 and the pistons 12. The temperature of oil in the oil pan when the engine 10 is under cold operation is lower than the temperature of oil in the oil pan when the engine 10 is under warm operation. Thus, the amount of fuel vaporized in the oil pan when the engine 10 is under cold operation is less than the amount of fuel vaporized in the oil pan when the engine 10 is under warm operation. As a result, the variation tendency of the air-fuel ratio differs between the case in which the engine 10 is under cold operation and the case in which the engine 10 is under warm operation.

For these reasons, the learning regions RP11 to RP15, RP21 to RP25, RP31 to RP35, and RP41 to RP45 are sorted into groups as shown in FIG. 6. That is, as shown in FIG. 6, the learning regions RP11 to RP15, in which the injector that performs fuel injection is the port injector 23 and the cold operation is being performed, form a first group GP11. The learning regions RP21 to RP25, in which the injector that performs fuel injection is the port injector 23 and the warm operation is being performed, form a second group GP12. The learning regions RP31 to RP35, in which the injector that performs fuel injection is the direct injector 24 and cold operation is being performed, form a third group GP13. The learning regions RP41 to RP45, in which the injector that performs fuel injection is the direct injector 24 and warm operation is being performed, form a fourth group GP14.

Next, a routine executed by the air-fuel ratio learning control section 130 at the time of updating the air-fuel ratio learning values KG of the learning regions RP11 to RP15, RP21 to RP25, RP31 to RP35, and RP41 to RP45 will be described with reference to the flowchart in FIG. 7. The routine differs from the routine of the first embodiment described with reference to FIG. 3 in the process performed after completing learning of the air-fuel ratio learning value KG of any one of the learning regions. Thus, the flowchart shown in FIG. 7 omits the process before learning of the air-fuel ratio learning value KG of any one of the learning regions is completed (the process from step S11 to step S13).

Figure 7:
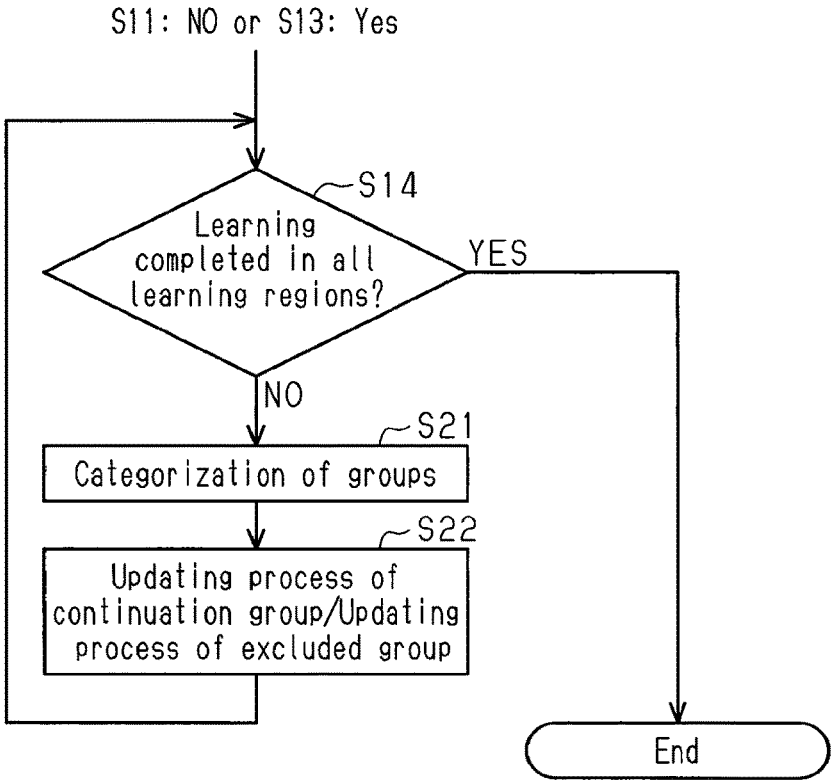
FIG. 7 is a flowchart illustrating part of the routine executed when the air-fuel ratio control apparatus for an engine according to the second embodiment updates the air-fuel ratio learning values of the learning regions.

As shown in FIG. 7, if there is any learning region in which learning of the air-fuel ratio learning value KG has been completed among all the learning regions RP11 to RP15, RP21 to RP25, RP31 to RP35, and RP41 to RP45 (step S11: NO or step S13: YES), the air-fuel ratio learning control section 130 shifts the process to step S14. In step S14, if learning of the air-fuel ratio learning value KG has been completed in all the learning regions RP11 to RP15, RP21 to RP25, RP31 to RP35, and RP41 to RP45 (step S14: YES), the air-fuel ratio learning control section 130 ends the present routine.

If there is any learning region in which learning of the air-fuel ratio learning value KG has not been completed (step S14: NO), the air-fuel ratio learning control section 130 executes a categorizing process in which the groups GP11 to GP14 are categorized into a continuation group and an excluded group (step S21). In this embodiment, the "continuation group" refers to a group that does not include the learning region in which learning of the air-fuel ratio learning value KG has been completed, and the "excluded group" refers to a group that includes the learning region in which learning of the air-fuel ratio learning value KG has been completed. For example, in a case in which learning of the air-fuel ratio learning value KG in the learning region RP13 has been completed, the first group GP11 including the learning region RP13 is divided into the excluded group. The groups GP12 to GP14 other than the first group GP11 are divided into the continuation group.

Subsequently, the air-fuel ratio learning control section 130 performs an updating process of the continuation group or an updating process of the excluded group (step S22). That is, if the engine 10 is operated in any one of the learning regions that belongs to the excluded group, the air-fuel ratio learning control section 130 performs the updating process of the excluded group. At this time, in updating the air-fuel ratio learning values KG of the learning regions in which learning has not been completed through the updating process of the excluded group, the air-fuel ratio learning control section 130 collectively updates the air-fuel ratio learning values KG of all the learning regions that belong to the same group as the above learning region and in which learning has not been completed. If the engine 10 is operated in the learning region in which learning has been completed, the air-fuel ratio learning control section 130 ends the process of step S22 without updating the air-fuel ratio learning values KG of all the learning regions that belong to the same group as the above learning region and in which learning has not been completed. When the updating process of the excluded group is performed, the air-fuel ratio learning control section 130 does not update the air-fuel ratio learning values KG of all the learning regions that do not belong to the excluded group.

If the engine 10 is operated in any one of the learning regions that belong to the continuation group, the air-fuel ratio learning control section 130 performs the updating process of the continuation group. At this time, the air-fuel ratio learning control section 130 collectively updates the air-fuel ratio learning values KG of all the learning regions that do not belong to the excluded group through the updating process of the continuation group. When the updating process of the continuation group is performed, the air-fuel ratio learning control section 130 does not update the air-fuel ratio learning values KG of the learning regions that belong to the excluded group and in which learning has not been completed. Subsequently, the air-fuel ratio learning control section 130 shifts the process to the aforementioned step S14.

Next, operation and advantages of the case in which the air-fuel ratio learning values KG of the learning regions RP11 to RP15, RP21 to RP25, RP31 to RP35, and RP41 to RP45 are updated through the routine described with reference to FIG. 7 will be described.

For example, if learning of the air-fuel ratio learning value KG of the learning region RP13 is completed among all the learning regions RP11 to RP15, RP21 to RP25, RP31 to RP35, and RP41 to RP45, the first group GP11 is divided into the excluded group, and the groups GP12 to GP14 other than the first group GP11 are divided into the continuation group.

In this state, the engine 10 may be operated in the learning region RP12 that belongs to the first group GP11 (excluded group) and in which learning of the air-fuel ratio learning value KG has not been completed. If the learning condition is satisfied under this situation, learning of the air-fuel ratio learning value KG of the learning region RP12 is performed. At this time, the air-fuel ratio learning values KG of the learning regions RP11, RP12, RP14, and RP15 are collectively updated. This increases the efficiency in learning the air-fuel ratio learning values KG in all the learning regions that belong to the first group having similar variation tendencies of the air-fuel ratio and in which learning has not been completed. In this case, the air-fuel ratio learning values KG of the learning regions RP21 to RP25, RP31 to RP35, and RP41 to RP45 that do not belong to the first group GP11 are not updated and maintained.

After learning of the air-fuel ratio learning value KG of the learning region RP13 has been completed, the engine 10 may be operated in the learning region (for example, the learning region RP23) that does not belong to the first group GP11 (that is, the excluded group). If the learning condition is satisfied under this situation, learning of the air-fuel ratio learning value KG of the learning region RP23 is performed. At this time, the air-fuel ratio learning values KG of all the learning regions RP21 to RP25, RP31 to RP35, and RP41 to RP45 that do not belong to the first group GP11 are collectively updated. Thus, even after completing learning of the air-fuel ratio learning value KG in at least one of the learning regions, the efficiency in learning the air-fuel ratio learning values KG of all the learning regions that do not belong to the excluded group is increased.

Under this situation, for example, learning of the air-fuel ratio learning value KG of the learning region RP23 may be completed. In this case, the second group GP12 to which the learning region RP23 belongs is also divided as the excluded group. Thus, if the learning condition is satisfied when the engine 10 is operated in the learning region that belongs to the second group GP12 and in which learning of the air-fuel ratio learning value KG has not been completed (for example, the learning region RP21), the air-fuel ratio learning values KG of the learning regions RP21, RP22, RP24, RP25 are collectively updated. The air-fuel ratio learning values KG of all the learning regions RP31 to RP35 and RP41 to RP45 that belong to the third group GP13 and the fourth group GP14 are not updated. The air-fuel ratio learning values KG of the learning regions RP11, RP12, RP14, and RP15 that belong to the first group GP11, which is the excluded group other than the second group GP12, and in which learning has not been completed are also not updated.

Third Embodiment

An air-fuel ratio control apparatus for an engine according to a third embodiment will now be described with reference to FIG. 8. In the present embodiment, the process after learning of the air-fuel ratio learning value KG of one of all the learning regions has been completed differs from that of the second embodiment. Accordingly, differences from the second embodiment will mainly be discussed below, and like or the same reference numerals are given to those components that are the same as the corresponding components of the second embodiment. Such components will not be described.

Figure 8:
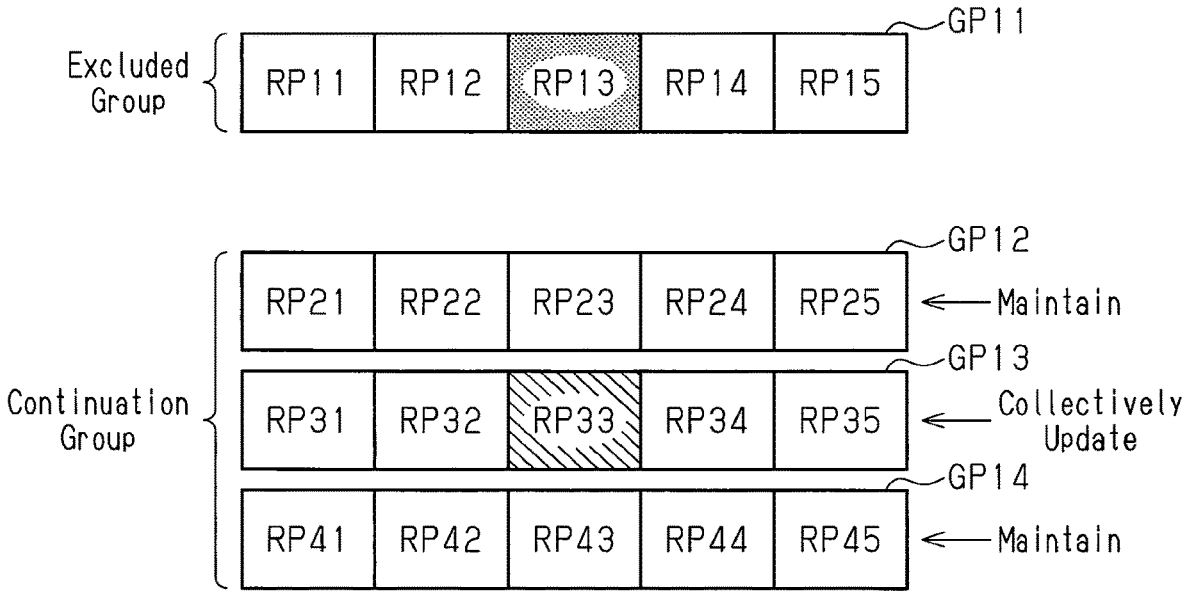
FIG. 8 is an operation diagram illustrating a manner in which an air-fuel ratio control apparatus for an engine according to a third embodiment updates the air-fuel ratio learning values of the learning regions.

For example, as shown in FIG. 8, under the situation in which learning of the air-fuel ratio learning value KG of the learning region RP13 has been completed, the engine 10 may be operated in the learning region that belongs to the first group GP11, which is the excluded group (for example, the learning region RP11). At this time, if the learning condition is satisfied, the updating process of the excluded group is executed. That is, like the second embodiment, the air-fuel ratio learning control section 130 collectively updates the air-fuel ratio learning values KG of all the learning regions RP11, RP12, RP14, and RP15 that belong to the first group GP11 and in which learning has not been completed.

Under the situation in which learning of the air-fuel ratio learning value KG of the learning region RP13 has been completed, the engine 10 may be operated in the learning region RP33 that belongs to the third group GP13 among the groups GP12 to GP14, which are the continuation group. If the learning condition is satisfied in this state, the updating process of the continuation group is executed.

In this embodiment, unlike the second embodiment, the air-fuel ratio learning control section 130 collectively updates the air-fuel ratio learning values KG of all the learning regions RP31, RP32, RP34, and RP35 that belong to the third group GP13. The air-fuel ratio learning control section 130 does not update the air-fuel ratio learning values KG of the learning regions RP21 to RP25 and RP41 to RP45 that belong to the groups GP12 and GP14, which are the continuation group other than the third group GP13.

That is, when learning of the air-fuel ratio learning value KG of any one of the learning regions is completed, the air-fuel ratio learning values KG of all the learning regions RP11 to RP15, RP21 to RP25, RP31 to RP35, and RP41 to RP45 are set to values that reflect the variation of the individual engine to some degree. Thus, after completing learning in any one of the learning regions, the air-fuel ratio learning values KG of learning regions are collectively updated on group-by-group basis for similar variation tendencies of the air-fuel ratio. Thus, even after learning of the air-fuel ratio learning value KG of at least one learning region has been completed, the efficiency in learning the air-fuel ratio learning values KG of the learning regions is increased on group-by-group basis.

Fourth Embodiment

An air-fuel ratio control apparatus for an engine according to a fourth embodiment will now be described with reference to FIG. 9. In the present embodiment, a method for updating the air-fuel ratio learning values KG of the learning regions that belong to the excluded group and in which learning has not been completed differs from the methods according to the second embodiment and the third embodiment. Accordingly, differences from the second and third embodiments will mainly be discussed below, and like or the same reference numerals are given to those components that are the same as the corresponding components of the second and third embodiment. Such components will not be described.

Each of the groups GP11 to GP14 includes the learning regions having similar variation tendencies of the air-fuel ratio. Thus, in a case in which learning of the air-fuel ratio learning value KG has not been completed in any of the learning regions that belong to a certain group, at the time of updating the air-fuel ratio learning value KG of any one of the learning regions, the air-fuel ratio learning values KG of other learning regions are updated so that the efficiency in learning the air-fuel ratio learning value KG of the learning region is increased on group-by-group basis. In a case in which learning of the air-fuel ratio learning value KG of one of the learning regions that belong to a certain group is completed, the air-fuel ratio learning values KG of other learning regions are set to values that reflect the variation of the individual engine to some degree. Thus, the air-fuel ratio learning control section 130 individually updates the air-fuel ratio learning value KG of each learning region in all the learning regions that belong to the excluded group and in which learning of the air-fuel ratio learning value KG has not been completed.

Figure 9:
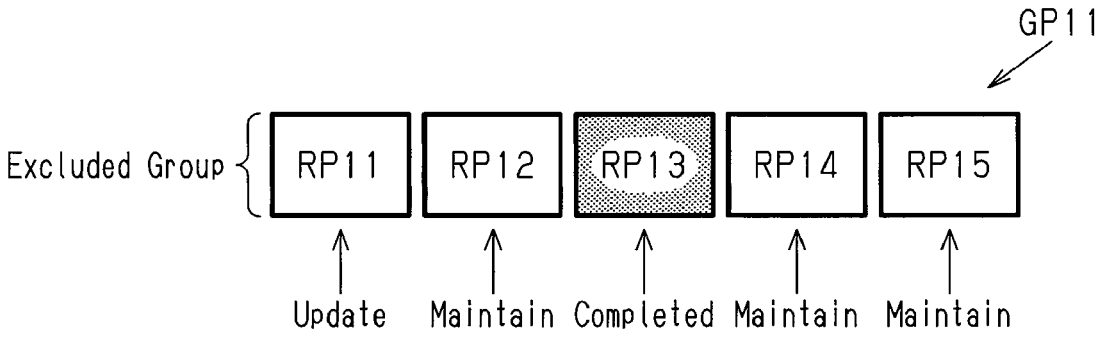
FIG. 9 is an operation diagram illustrating a manner in which an air-fuel ratio control apparatus for an engine according to a fourth embodiment updates the air-fuel ratio learning value of each learning region that belongs to an excluded group.

For example, as shown in FIG. 9, when learning of the air-fuel ratio learning value KG of the learning region RP13 has been completed, and the first group GP11 is the excluded group, the air-fuel ratio learning control section 130 does not collectively update the air-fuel ratio learning values KG of other learning regions RP11, RP12, RP14, RP15 that belong to the first group GP11 through the updating process of the excluded group. More specifically, for example, if the learning condition is satisfied under the situation in which the engine 10 is operated in the learning region RP11, the air-fuel ratio learning control section 130 updates the air-fuel ratio learning value KG of the learning region RP11 but does not update the air-fuel ratio learning values KG of other learning regions RP12, RP14, RP15 in which learning has not been completed.

The above illustrated embodiments may be modified as follows.

In each of the above-described second to fourth embodiments, as long as the learning regions are sorted into groups of regions having similar variation tendencies of the air-fuel ratio, the regions may be sorted into groups differently from the groupings shown in FIG. 6. For example, the learning regions may be sorted into groups in accordance with the type of the injector that performs fuel injection and the intake air amount GA. That is, the variation of the output property of the air flowmeter 51 may be changed in accordance with the intake air amount GA. Thus, the variation tendency of the air-fuel ratio may vary in accordance with the intake air amount GA detected by the air flowmeter 51.

Figure 10:
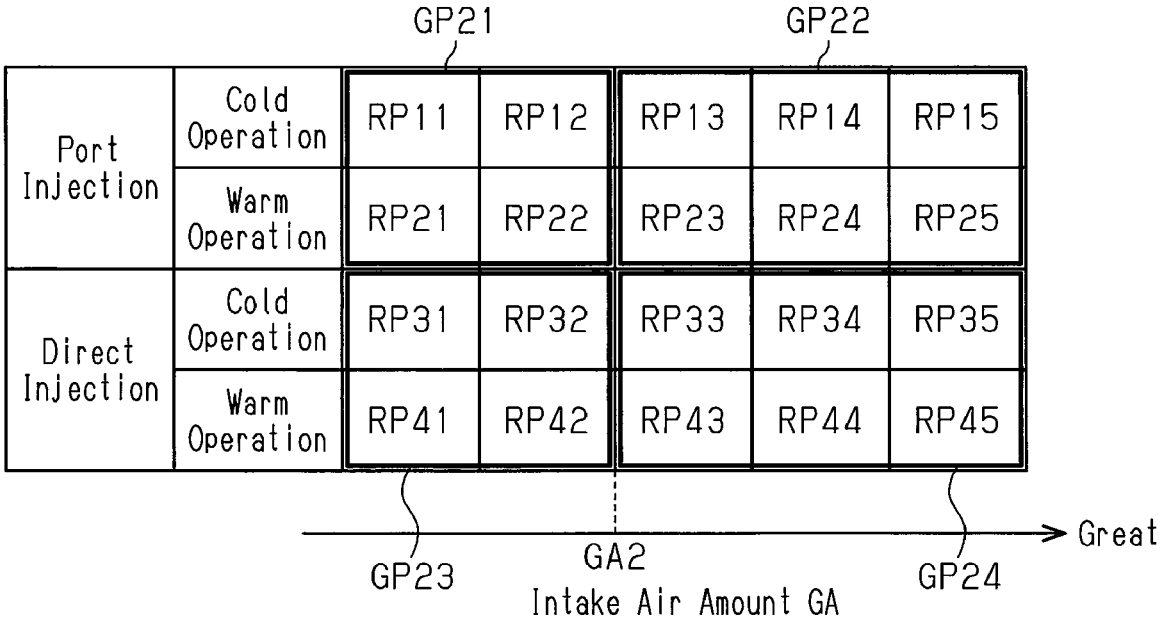
FIG. 10 is a diagram illustrating how an air-fuel ratio control apparatus for an engine according to a modification groups the learning regions.

FIG. 10 shows exemplary groupings determined in accordance with the type of the injector that performs fuel injection and the intake air amount GA. That is, as shown in FIG. 10, a first group GP21 includes the learning regions RP11, RP12, RP21, and RP22 in which the injector that performs fuel injection is the port injector 23 and the intake air amount GA is less than the second intake air amount GA2. A second group GP22 includes the learning regions RP13, RP14, RP15, RP23, RP24, and RP25 in which the injector that performs fuel injection is the port injector 23 and the intake air amount GA is greater than or equal to the second intake air amount GA2. A third group GP23 includes the learning regions RP31, RP32, RP41, and RP42 in which the injector that performs fuel injection is the direct injector 24 and the intake air amount GA is less than the second intake air amount GA2. A fourth group GP24 includes the learning regions RP33, RP34, RP35, RP43, RP44, and RP45 in which the injector that performs fuel injection is the direct injector 24 and the intake air amount GA is greater than or equal to the second intake air amount GA2.

In addition to the type of the injector that performs fuel injection and the intake air amount GA, the learning regions may also be sorted into groups based on whether the engine 10 is under cold operation or warm operation. For example, the groups GP21, GP22, GP23, and GP24 shown in FIG. 10 may be divided based on whether cold operation or warm operation is being performed so that eight groups are formed.

As long as the air-fuel ratio learning values KG of all the learning regions are collectively updated when learning of the air-fuel ratio learning value KG has been completed in none of the learning regions, the air-fuel ratio learning value KG may be individually updated in each learning region after learning of the air-fuel ratio learning value KG of any one of the learning regions has been completed. In this case also, the air-fuel ratio learning values KG of all the learning regions are collectively updated until learning of the air-fuel ratio learning value KG of one of the learning regions is completed. Thus, the air-fuel ratio learning values KG of other learning regions in which learning has not been completed reflect the variation of the individual engine 10 to some degree. Thus, the efficiency in learning the air-fuel ratio learning value is increased from an early stage.

The engine equipped with the air-fuel ratio control apparatus may be an engine that includes only the port injectors 23 or the direct injectors 24 as long as the operating region is divided into multiple operating regions, and the fuel supply amount is calculated using the air-fuel ratio learning value KG of each operating region.

The invention claimed is:

1. An air-fuel ratio control apparatus that controls an air-fuel ratio of air-fuel mixture combusted in an engine to a target air-fuel ratio by correcting a fuel supply amount in accordance with an air-fuel ratio feedback correction value and an air-fuel ratio learning value, the apparatus comprising:

an air-fuel ratio feedback control section, which updates the air-fuel ratio feedback correction value such that a difference between the air-fuel ratio calculated based on an oxygen concentration detected by an air-fuel ratio sensor and the target air-fuel ratio is reduced; and an air-fuel ratio learning control section, wherein the air-fuel ratio learning control section performs, in each of a plurality of learning regions divided in accordance with an operating condition of the engine, learning of the air-fuel ratio learning value, in which the air-fuel ratio learning value is updated to reduce the air-fuel ratio feedback correction value and the updated air-fuel ratio learning value is stored, and if the air-fuel ratio feedback correction value converges to a value less than or equal to a specified value in each learning region, the air-fuel ratio learning control section determines that learning of the air-fuel ratio learning value in the learning region has been completed, wherein, if it is determined that learning of the air-fuel ratio learning value has not yet been completed in any of the learning regions, the air-fuel ratio learning control section collectively updates the air-fuel ratio learning values of each of the plurality of learning regions at the time of updating the air-fuel ratio learning value through the learning in any of the learning regions, the learning regions are sorted into groups of regions having similar variation tendencies of the air-fuel ratio, a group including the learning region in which the learning has been completed is defined as an excluded group, a group that does not include the learning region in which the learning has been completed is defined as a continuation group, and if it has already been determined that the learning has been completed in any of the learning regions and there are a plurality of continuation groups, the air-fuel ratio learning control section collectively updates, at the time of updating the air-fuel ratio learning value through the learning in any of the learning regions that belong to any one of the continuation groups, the air-fuel ratio learning values of all the learning regions that belong to the any one of the continuation groups.

2. The air-fuel ratio control apparatus for an engine according to claim 1, wherein, if it has already been determined that the learning has been completed in any of the learning regions, the air-fuel ratio learning control section collectively updates, at the time of updating the air-fuel ratio learning value through the learning in any of the learning regions in which the learning has not been completed, the air-fuel ratio learning values of all the learning regions in which the learning has not been completed.

3. The air-fuel ratio control apparatus for an engine according to claim 1, wherein, at the time of updating the air-fuel ratio learning value through the learning in any of the learning regions that belong to the excluded group and in which the learning has not been completed, the air-fuel ratio learning control section collectively updates the air-fuel ratio learning values of all the learning regions in which the learning has not been completed and that belong to the same group as the learning region in which the air-fuel ratio learning value is to be updated.

4. The air-fuel ratio control apparatus for an engine according to claim 1, wherein the air-fuel ratio learning control section individually updates the air-fuel ratio learning value of each learning region in all the learning regions that belong to the excluded group and in which the learning has not been completed.

5. The air-fuel ratio control apparatus for an engine according to claim 1, wherein the learning regions are sorted into groups based on whether warm operation or cold operation is being performed.

6. The air-fuel ratio control apparatus for an engine according to claim 1, wherein the learning regions are sorted into groups based on the intake air amount.

7. The air-fuel ratio control apparatus for an engine according to claim 1, wherein the engine includes two kinds of injectors for direct injection and port injection, and the learning regions are sorted into groups based on the type of the injectors that perform injection.

8. An air-fuel ratio control apparatus that controls an air-fuel ratio of air-fuel mixture combusted in an engine to a target air-fuel ratio by correcting a fuel supply amount in accordance with an air-fuel ratio feedback correction value and an air-fuel ratio learning value, the apparatus comprising:

an air-fuel ratio feedback control section, which updates the air-fuel ratio feedback correction value such that a difference between the air-fuel ratio calculated based on an oxygen concentration detected by an air-fuel ratio sensor and the target air-fuel ratio is reduced; and an air-fuel ratio learning control section, wherein the air-fuel ratio learning control section performs, in each of a plurality of learning regions divided in accordance with an operating condition of the engine, learning of the air-fuel ratio learning value, in which the air-fuel ratio learning value is updated to reduce the air-fuel ratio feedback correction value and the updated air-fuel ratio learning value is stored, and if the air-fuel ratio feedback correction value converges to a value less than or equal to a specified value in each learning region, the air-fuel ratio learning control section determines that learning of the air-fuel ratio learning value in the learning region has been completed, wherein, if it is determined that learning of the air-fuel ratio learning value has not yet been completed in any of the learning regions, the air-fuel ratio learning control section collectively updates the air-fuel ratio learning values of each of the plurality of learning regions at the time of updating the air-fuel ratio learning value through the learning in any of the learning regions, the learning regions are sorted into groups of regions having similar variation tendencies of the air-fuel ratio, a group including the learning region in which the learning has been completed is defined as an excluded group, a group that does not include the learning region in which the learning has been completed is defined as a continuation group, and if it has already been determined that the learning has been completed in any of the learning regions, the air-fuel ratio learning control section collectively updates, at the time of updating the air-fuel ratio learning value through the learning in any of the learning regions that belong to the continuation group, the air-fuel ratio learning values of all the learning regions that do not belong to the excluded group.

* * * * *